US012312112B2

(12) United States Patent
Scrivani

(10) Patent No.: US 12,312,112 B2
(45) Date of Patent: May 27, 2025

(54) APPARATUS FOR THE MANUFACTURE OF A FILTER FOR DISPOSABLE CAPSULES FOR THE PREPARATION OF BEVERAGES

(71) Applicant: Rychiger AG, Steffisburg (CH)

(72) Inventor: Massimo Scrivani, Casteggio (IT)

(73) Assignee: Rychiger AG (CH)

( * ) Notice: Subject to any disclaimer, the term of this patent is extended or adjusted under 35 U.S.C. 154(b) by 62 days.

(21) Appl. No.: 18/025,733

(22) PCT Filed: Sep. 15, 2021

(86) PCT No.: PCT/EP2021/075357
§ 371 (c)(1),
(2) Date: Mar. 10, 2023

(87) PCT Pub. No.: WO2022/058366
PCT Pub. Date: Mar. 24, 2022

(65) Prior Publication Data

US 2023/0356869 A1 Nov. 9, 2023

(30) Foreign Application Priority Data

Sep. 15, 2020 (CH) ..... 01153/20
Sep. 15, 2020 (IT) ..... 102020000021760

(51) Int. Cl.
*B65B 29/02* (2006.01)
*B65B 43/50* (2006.01)
(Continued)

(52) U.S. Cl.
CPC ..... *B65B 29/022* (2017.08); *B65B 43/50* (2013.01); *B65B 47/06* (2013.01); *B65B 61/20* (2013.01)

(58) Field of Classification Search
CPC ..... B65B 29/022; B65B 43/50; B65B 47/06; B65B 61/20
See application file for complete search history.

(56) References Cited

U.S. PATENT DOCUMENTS 2,359,432 A 10/1944 McNamara
4,092,817 A * 6/1978 Rist, III ..... B29C 65/7451 220/709
(Continued)

FOREIGN PATENT DOCUMENTS

CA 3055898 A1 9/2016
CN 101454207 A 6/2009
(Continued)

OTHER PUBLICATIONS

Search Report from IT202000021760 dated May 25, 2021 in Italian.
(Continued)

*Primary Examiner* — Lucas E. A. Palmer
(74) *Attorney, Agent, or Firm* — Lerner David LLP

(57) ABSTRACT

An apparatus is disclosed for the manufacture of a filter for disposable capsules for the preparation of beverages from a flat disc made of filtering material. The apparatus comprises a transfer element for transferring the flat disc, a forming element for forming the flat disc to conform it in a cup shape with a pleating on a lateral perimeter surface thereof, an insertion element for inserting the pleated cup inside a waterproof cup as well as a retaining element for continuously retaining the flat disc in a predetermined position at least in the transfer and forming elements and during the transfer thereof between the transfer and forming elements.

13 Claims, 17 Drawing Sheets

(51) Int. Cl.
*B65B 47/06* (2006.01)
*B65B 61/20* (2006.01)

(56) References Cited

U.S. PATENT DOCUMENTS 4,736,568 A * 4/1988 Shaw ..... B29C 66/612 53/290
6,440,256 B1 * 8/2002 Gordon ..... B65B 43/10 156/227
10,988,270 B2 * 4/2021 Gorbatenko ..... B65B 51/14
11,084,650 B2 * 8/2021 Krüger ..... B32B 5/022
2005/0051478 A1 * 3/2005 Karanikos ..... B65D 85/8061 210/477
2005/0217213 A1 * 10/2005 Lozinski ..... A47J 31/44 53/559
2008/0314256 A1 * 12/2008 Smith ..... B65D 85/816 99/298
2009/0211713 A1 8/2009 Binacchi
2009/0241468 A1 10/2009 Bernardi et al.
2015/0246741 A1 * 9/2015 Hansen ..... B65B 29/022 156/215
2017/0096243 A1 * 4/2017 Manaresi ..... B29C 66/8322
2017/0355515 A1 * 12/2017 Marcinkowski ..... A47J 31/407
2020/0339292 A1 * 10/2020 Trautwein ..... B65B 31/025
2023/0271733 A1 * 8/2023 Biondi ..... B65B 7/01 53/296
2023/0294857 A1 * 9/2023 Biondi ..... B65B 29/022 53/485

FOREIGN PATENT DOCUMENTS

EP 2093148 A1 * 8/2009 ..... B65B 29/02
EP 2093148 B1 9/2011
EP 2829392 A1 1/2015
EP 3434455 A1 1/2019
GB 191208339 A 2/1913

OTHER PUBLICATIONS

Search Report from IT202000021760 dated May 25, 2021 translated into English.
Machine language translation into English of EP2829392A1.
Search Report dated Dec. 26, 2024 from the Office Action for Chinese Application No. 202180062927.6 issued Dec. 28, 2024, 2 pages.

* cited by examiner

APPARATUS FOR THE MANUFACTURE OF A FILTER FOR DISPOSABLE CAPSULES FOR THE PREPARATION OF BEVERAGES

CROSS REFERENCE TO RELATED APPLICATIONS

This application is a national phase of international application PCT/EP2021/075357, filed 15 Sep. 2021, which claims the benefit of priority to Italian patent application IT 102020000021760, filed Sep. 15, 2020, and Swiss patent application CH01153/20, filed Sep. 15, 2020, which the content of each of the aforementioned patent applications being incorporated herein by reference.

BACKGROUND OF THE INVENTION

Field of the Invention

The present invention relates to an apparatus for the manufacture of disposable capsules for the preparation of beverages.

Description of Related Art

Disposable capsules for the preparation of beverages, typically coffee, and particularly "American-style" or "filter coffee" have long been on the market.

Traditionally, this beverage was prepared by simple contact and subsequent percolation of hot water into a container through a filter, usually made of paper or metal, filled with coffee powder.

More recently, easy-to-handle disposable capsules are being used in machines designed to prepare this beverage.

The disposable capsule is generally formed by a waterproof, cup-shaped outer casing, into the upper part of which there is inserted a paper filter, also cup-shaped, welded internally to the casing along the upper edge at the mouth.

In order to increase the filtering surfaces and to create ducts through which the filtered beverage can better reach the lower part of the waterproof casing, the paper filter is pleated along the lateral walls before insertion.

Subsequently, the filter is filled with food substances, such as soluble or partially soluble coffee powders, and the cup-shaped waterproof outer casing is closed at the top with a waterproof film sealed at the edge, generally after replacing and/or enriching the residual air in the container with inert gas to protect the food substance, thus creating the disposable capsule.

Devices and plants for the manufacture of disposable capsules for the preparation of beverages as described above have been on the market for some time.

It is well known that such plants traditionally have successive processing stations along a production line in which the various activities necessary for packaging the finished disposable capsule are subsequently carried out.

As is known, EP 2 093 148 B1 (Opem SpA) also describes a plant for the manufacture of disposable capsules for the preparation of beverages, which plant consists of a production line along which there are means for forming the paper filter and means for inserting it into a waterproof container to the edge of which the filter is welded after adjustment of the exact level of its insertion.

It is well known that a critical issue in automatic systems for the manufacture of disposable capsules is the exact positioning of the preformed paper filter in the waterproof container, which is usually a cup.

Positioning the preformed filter in the waterproof container not in exact axial alignment and/or not exactly at the specified height leads to subsequent imperfect welding of the filter to the container, its unacceptability, and therefore to high production waste and rejection of the part.

The need for specific means of adjusting the exact positioning of the preformed filter in the waterproof container also limits the production speed of the system. Such conventional systems for the manufacture of disposable capsules for the preparation of beverages are therefore known to involve a dedicated processing station or specific dedicated devices for the exact positioning of the preformed filter in the waterproof container.

BRIEF SUMMARY OF THE INVENTION

There is thus a need to simplify the structure of traditional systems for the manufacture of disposable capsules for the preparation of well-known drinks.

The technical problem addressed by the present invention is therefore to create an apparatus for the manufacture of disposable capsules for the preparation of beverages which eliminates the technical disadvantages from the prior art.

Within the scope of this technical problem, an object of the invention is to create an apparatus for manufacturing disposable capsules for the preparation of beverages which positions the preformed filter in the waterproof container in exact axial alignment.

A further object of the invention is to create an apparatus for manufacturing disposable capsules for the preparation of beverages which positions the preformed filter in the waterproof container at exactly the prescribed level.

A further object of the invention is to create an apparatus for manufacturing disposable capsules for the preparation of beverages that eliminates production waste.

Last but not least, yet a further object of the invention is to create an apparatus for manufacturing disposable capsules for the preparation of beverages that has a high production speed.

According to the present invention, the technical problem is solved, and also the above and other objects are achieved, by creating an apparatus for the manufacture of a filter for disposable capsules for the preparation of beverages from a flat disc made of filtering material, comprising a transfer means for transferring said flat disc to forming means for conforming said flat disc in a cup shape with a pleating on a lateral perimeter surface thereof, and an insertion means for inserting said pleated cup inside a waterproof cup, characterised in that it comprises a retaining means for continuously retaining said flat disc in a predetermined position at least in said transfer and forming means and during the transfer thereof between said transfer and forming means.

Other features of the present invention are also defined in the subsequent claims.

Further features and advantages of the invention will become clearer from the description of a preferred but not exclusive embodiment of the apparatus for manufacturing disposable capsules for the preparation beverages according to the invention, illustrated by way of indication and in a non-limiting manner in the appended figures.

BRIEF DESCRIPTION OF THE SEVERAL VIEWS OF THE DRAWINGS

Further advantages, features, and details of the various embodiments of this disclosure will become apparent from the ensuring description of a preferred exemplary embodiment and with the aid of the drawings. The features and combinations of features recited below in the description, as well as the features and feature combination shown after that in the drawing description or in the drawings alone, may be used not only in the particular combination received, but also in other combinations on their own, without departing from the scope of the disclosure.

The drawings used to explain the embodiments wherein.

In the figures, the same components are given the same reference symbols.

DETAILED DESCRIPTION OF THE INVENTION

Figure 1:
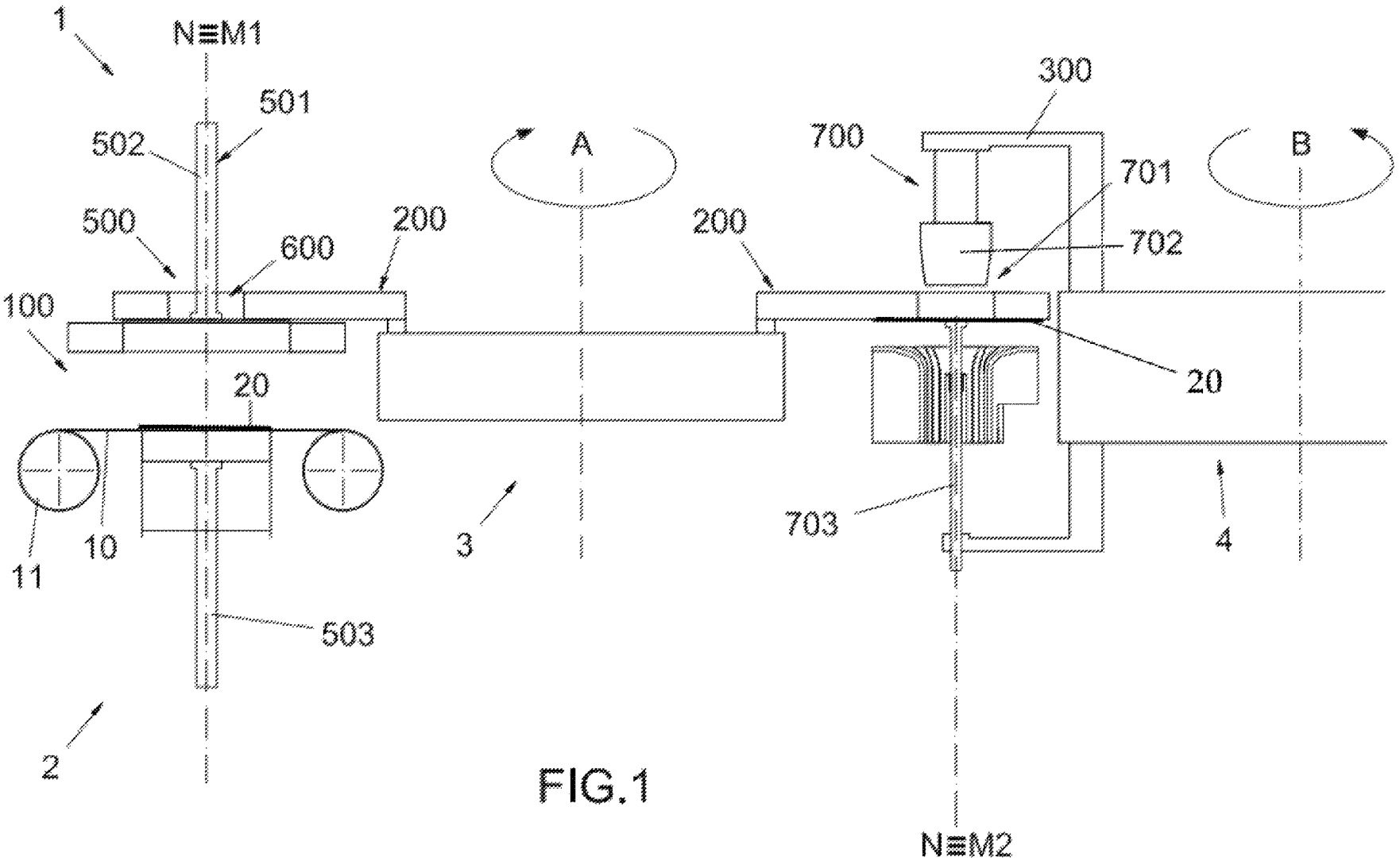
FIG. 1 shows a frontal schematic view of an apparatus according to the invention.
Figure 2:
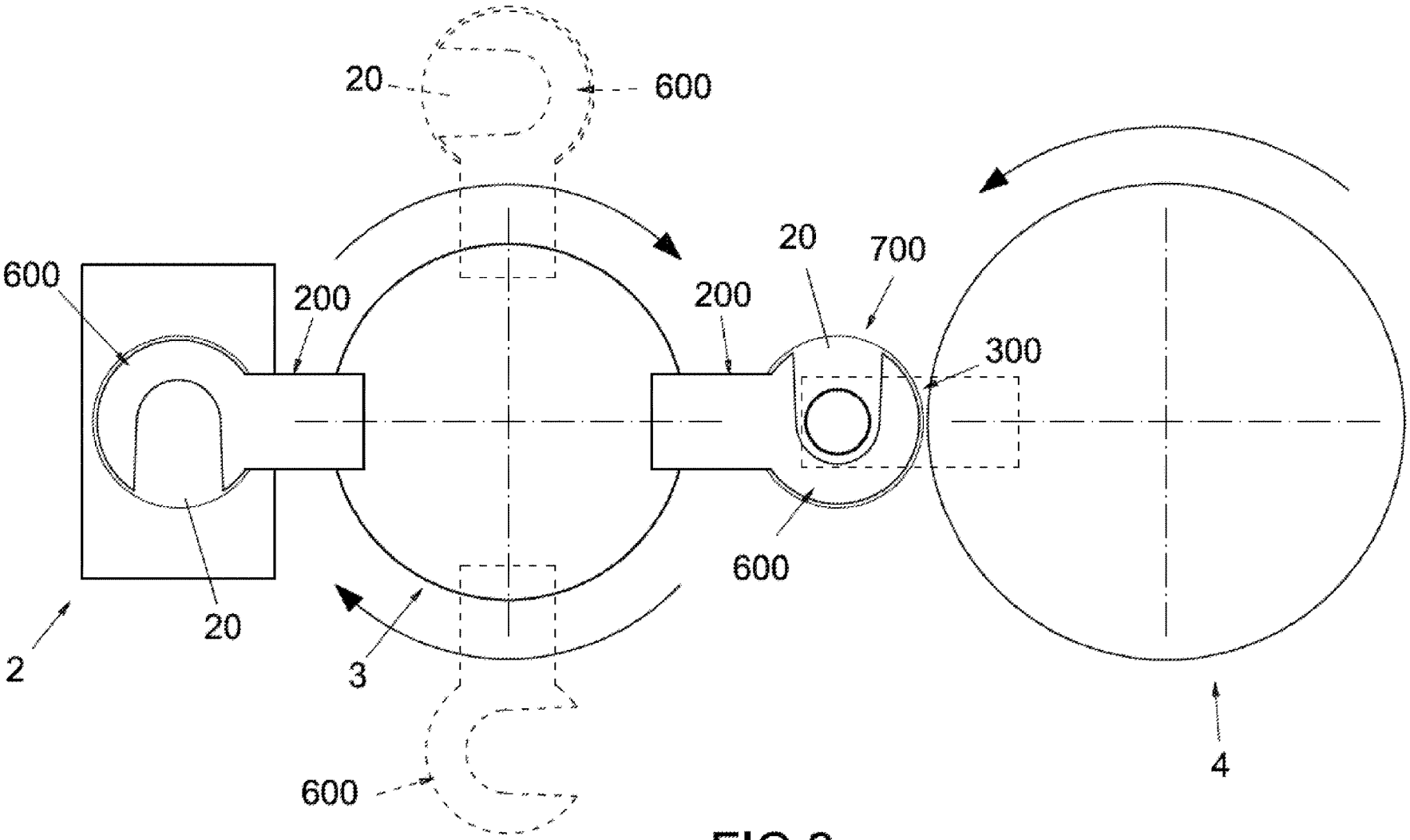
FIG. 2 shows a schematic plan view of an apparatus according to the invention.
Figure 5:
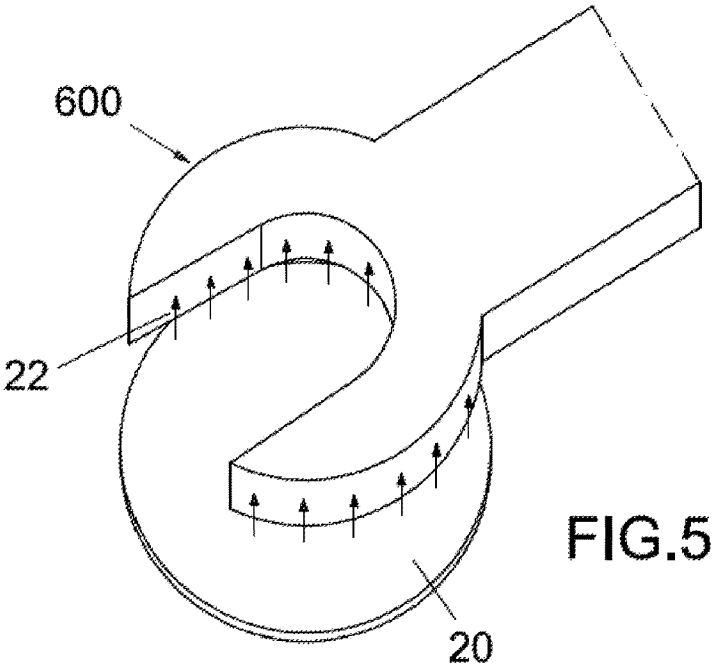
FIGS. 3, 4, 5 show continuous retaining means.
Figure 4:
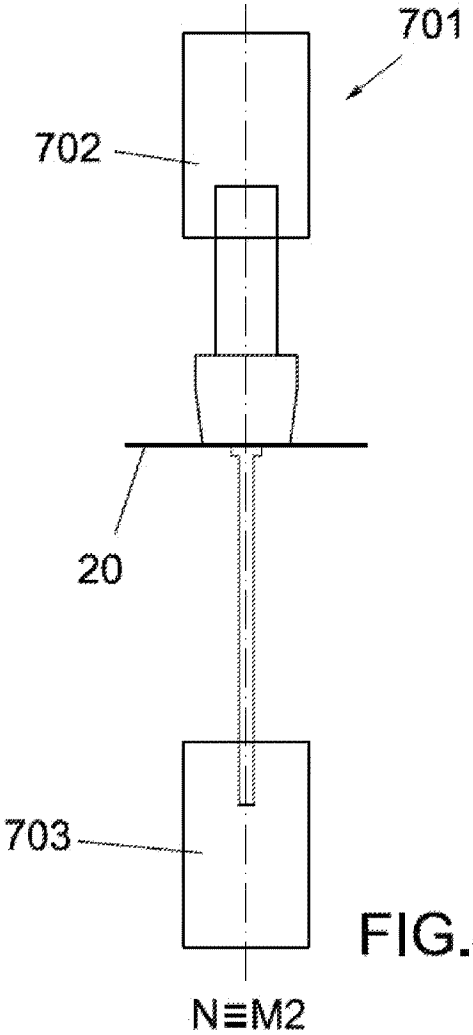
Figure 3:
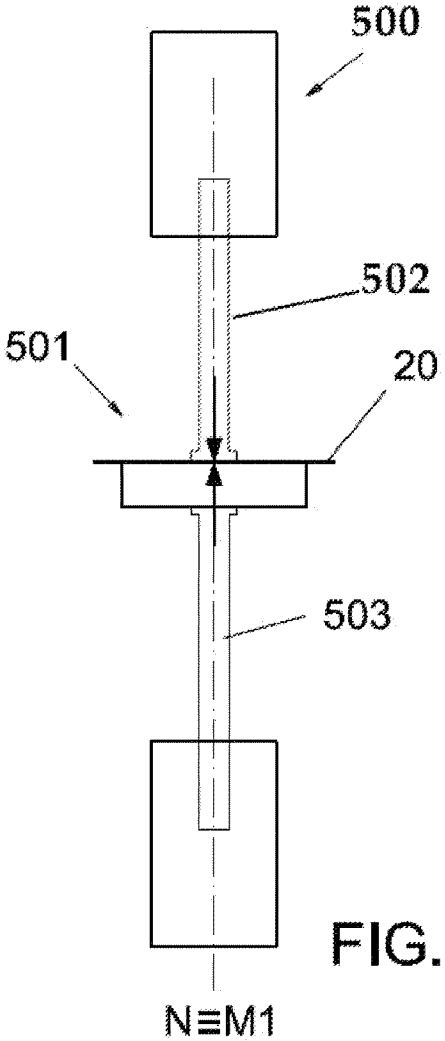
Figure 6:
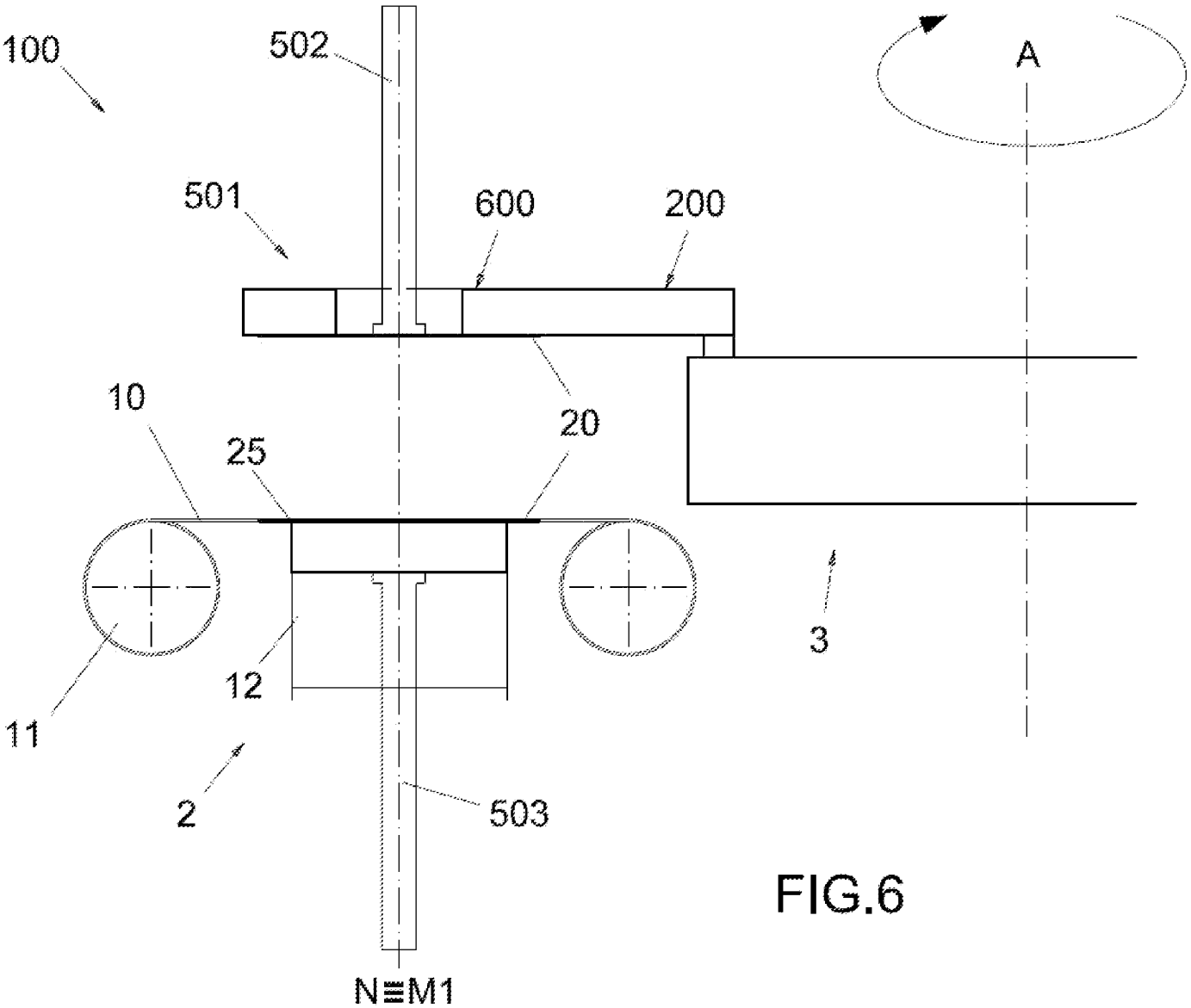
FIG. 6 shows a cutting station.

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B or C", then, unless specifically stated otherwise or infeasible, the component may include A, or B, or C, or A and B, or A and C, or B and C, or A and B and C. Expressions such as "at least one of" do not necessarily modify an entirety of the following list and do not necessarily modify each member of the list, such that at least one of "A, B, and C" should not be understood as including only one of A, only one of B, only one of C, or any combination of A, B, and C.

With reference to the above-mentioned figures, an apparatus for the manufacture of a filter for disposable capsules for the preparation of beverages is denoted overall by reference number 1.

In the figures, an apparatus 1 substantially comprising a cutting station 2, a first rotating carousel 3, and a second rotating carousel 4 is shown.

The cutting station 2 comprises cutting means 100 for cutting a strip of filter material 10 to create a flat disc 20; the first rotating carousel 3 comprises transfer means 200 for transferring the flat disc 20 from the cutting means 100 to the forming means 300; the second rotating carousel 4 comprises forming means 300 for forming the flat disc 20 to conform it to the shape of a pleated cup 21, and insertion means 400 for inserting the pleated cup 21 internally into a waterproof cup 30.

The apparatus 1 further comprises continuous retaining means 600 in the transfer means 200 and continuous retaining means 700 in the forming means 300, which hold the flat disc 20 in a predetermined position, and possibly continuous retaining means 500 in the cutting means 100.

The continuous retaining means 500 in the cutting means 100, if provided, may comprise a kinematic mechanism for mechanically retaining the flat disc 20, comprising at least one pair of longitudinally coaxial pistons 501 with opposite activation, typically an upper piston 502 and a lower piston 503.

The continuous retaining means 700 in the forming means 300 comprise a kinematic mechanism for mechanically retaining the flat disc 20, comprising at least one pair of longitudinally coaxial pistons 701 with opposite activation, typically an upper piston 702 and a lower piston 703.

The opposite, coordinated coaxial activation of the pistons of the pair 501 and pair 701 along their respective longitudinal axes M1 and M2 engages and retains the flat disc 20 in the predetermined position in the cutting means 100 and the forming means 300.

Expediently, the pairs of coaxial pistons 501 and 701 retain the flat disc 20 with its orthogonal axis N passing through its centre coinciding with their respective longitudinal axes M1 and M2.

The retaining means 600 for continuously retaining the flat disc 20 in the transfer means 200 between the cutting means 100 and the forming means 300 operate by pneumatic suction of the flat disc 20 along a partial circular crown 22.

Expediently, the means for the pneumatic suction of the flat disc 20 comprise means for transferring the flat disc 20, which transfer means have a plurality of partial circular crowns 22*i* positioned on the circumference of the first carousel 3, which rotates about its axis A.

Expediently, the forming means 300 are positioned on the circumference of the second carousel 4, which rotates about its axis B.

Expediently, the rotation axis A of the first carrousel 3 and the rotation axis B of the second carrousel 4 are parallel.

The continuous retaining means 500 in the cutting means 100, the continuous retaining means 600 in the transfer means 200, and the continuous retaining means 700 in the forming means 300 retain the flat disc 20 in a predetermined position with its orthogonal axis N parallel to the rotation axis A of the first carousel 3 and parallel to the rotation axis B of the second carousel 4.

The transfer means 200 positioned on the circumference of the first carousel 3 transfer the flat discs 20 from the cutting means 100 to the forming means 300 positioned on the circumference of the second carousel 4.

The cutting means 100 comprise at least one unwinder/winder 11 for the strip of filtering material 10 with discontinuous advancement coordinated with the activation of the retaining means 500 for continuously retaining the strip 10 in orthogonal axial alignment with the cutting path 25 of the flat disc 20.

The cutting means 100 comprise at least one cutting element 12, which, during pauses in the coordinated discontinuous advancement of the unwinder/winder 11, is activated and engaged against the filtering strip 10 in axial alignment with the cutting path 25, causing the flat disc 20 to be cut and detached.

In coordination with the activation of the cutting element 12, the continuous retaining means 500 are simultaneously activated and first engage the strip 10 in alignment with the cutting path 25, and then upon cutting and detachment engage the flat disc 20.

The continuous retaining means 500 engage and transfer the flat disc 20 until it engages with continuous retaining means 600 of the transfer means 200.

Expediently, the continuous retaining means 600 are activated prior to the release of the continuous retaining means 500 of the cutting means 100.

The continuous retaining means 600 of the transfer means 200 engage the flat disc 20 in an orderly manner until the subsequent coordinated engagement thereof by the continuous retaining means 700 of the forming means 300.

Expediently, the continuous retaining means 700 are activated prior to the release of the continuous retaining means 600 in the transfer means 200.

The forming means 300 comprise at least one ribbed matrix 301 with a smaller inner diameter than the diameter of the flat disc 20, and forcing means 302 for forcing the flat disc through the ribbed matrix 301.

These forming means 300 are positioned and act coaxially with the axis M2 of the continuous retaining means 700.

The continuous retaining means 700, typically the at least one pair of coaxial pistons 701 with opposite activation, retain the flat disc 20 with its orthogonal central axis N coinciding with the longitudinal axis M2 of said transfer means.

The forcing means 302 transfer axially along the longitudinal axis M2 the second pair of coaxial pistons 701, which retain the flat disc 20 through the ribbed matrix 301, conforming the flat disc 20 to the shape of a pleated cup 21 with a flat bottom 23, at the point of engagement of the upper opposite coaxial piston 702 with the lower opposite coaxial piston 703 of the pair of coaxial pistons 701, and a pleating on a lateral perimeter surface 24, forced against the walls of the ribbed matrix 301.

The continuous retaining means 700 engage the flat disc 20 during its conformation in the shape of a pleated cup 21, ensuring that its orthogonal central axis N exactly coincides with the vertical axis M2 of the ribbed matrix 301.

Along the axis M2 and vertically aligned with the forming means 300, there are positioned insertion means 400 for inserting the pleated cup 21 inside a waterproof cup 30 positioned in a seat 410 on the circumference of the second carousel 4 and vertically coaxial with the forming means 300 along the axis M2.

The waterproof cup 30 has a mouth 31 having a diameter greater than the diameter of the flat bottom 23 of the pleated cup 21.

Advantageously, the insertion means 400 for inserting the pleated cup 21 inside the waterproof cup 30 comprise at least one of the pair 701 of coaxial pistons 702 and 703 with opposite activation of the continuous retaining means 700 of the forming means 300, typically the upper piston 702, while the lower piston 703 is deactivated and moved away.

The insertion means 400 transfer along the axis M2 the upper piston 702 and insert the pleated cup 21 inside the waterproof cup 30 up to a mechanically predetermined height at which the outer involution circumference of the lateral surface 24 coincides with a reference height of the inner lateral surface of the waterproof cup 30.

Mechanical means 402 stop the insertion stroke of the upper piston 702 and the pleated cup 21 when this mechanically predetermined height is reached.

In a second preferred embodiment of the present invention, the upper coaxial piston 702 comprises pneumatic suction means 710 that retain the flat bottom 23 of the pleated cup 21 in an axial position, even in the absence of the opposite mechanical force of the lower coaxial piston 703.

Another advantageous feature of the present invention is that the transfer means 200 are formed by a plurality of transfer devices **200*i* positioned on the circumference of a first carousel 3** rotating about its axis A.

Likewise, the continuous retaining means 600 in the transfer means 200 are formed by a plurality of continuous retaining devices **600*i* in the plurality of transfer means 200*i***.

Figure 9:
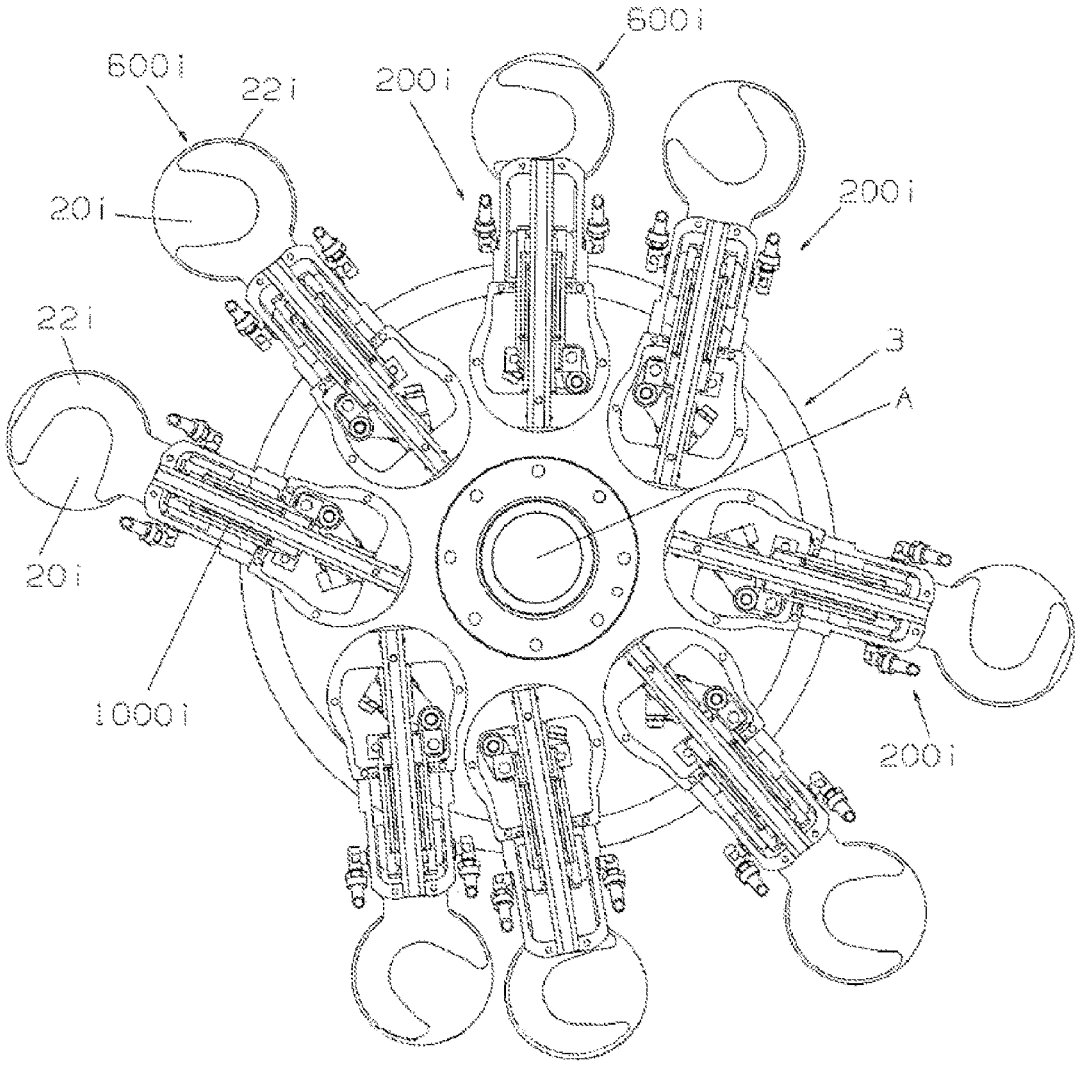
FIG. 9 shows a plan view from above the transfer carousel with the articulated arms assembled.
Figure 10:
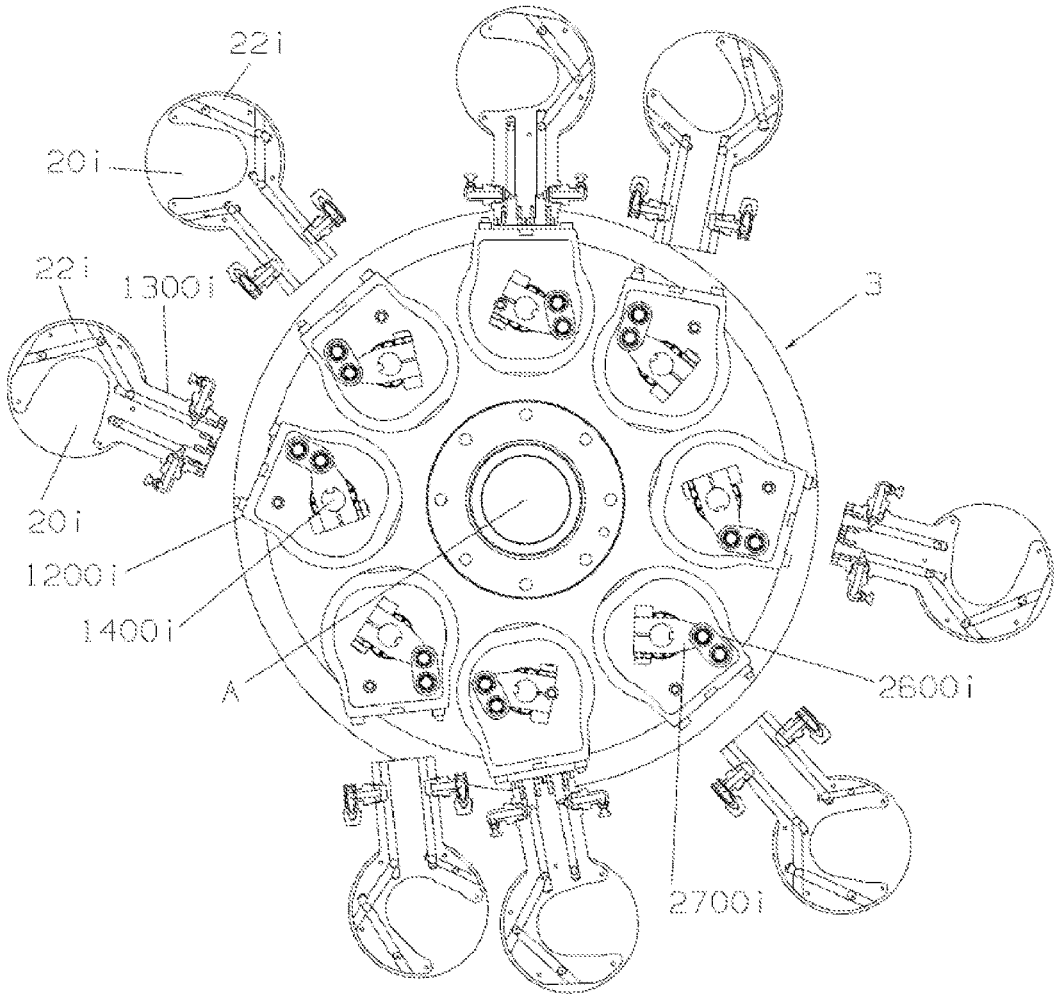
FIG. 10 shows a plan view from above the transfer carousel with the articulated arms disassembled.
Figure 11:
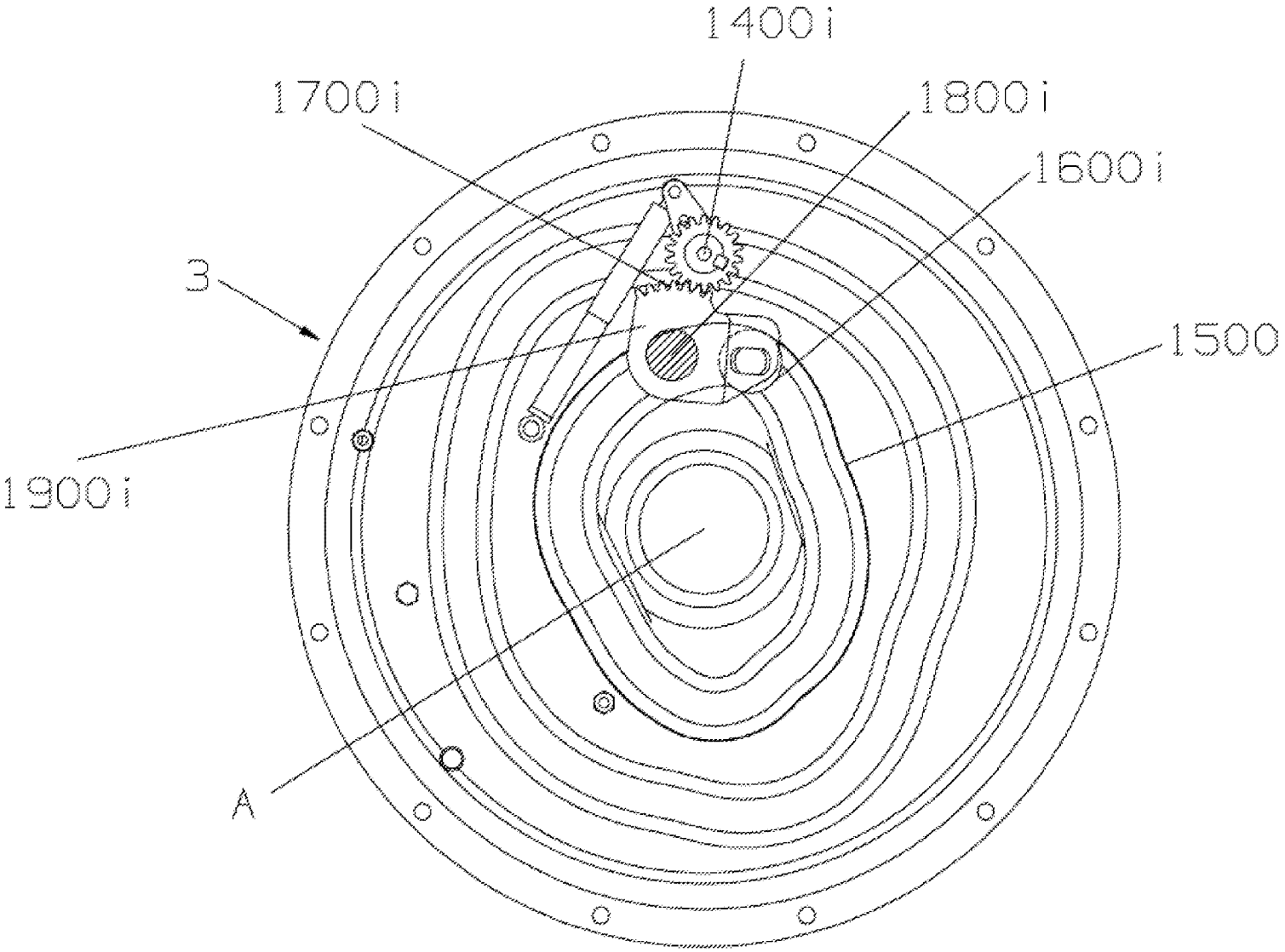
FIG. 11 shows a plan view from below the transfer carousel highlighting the rotary movement system of an articulated arm.
Figure 12:
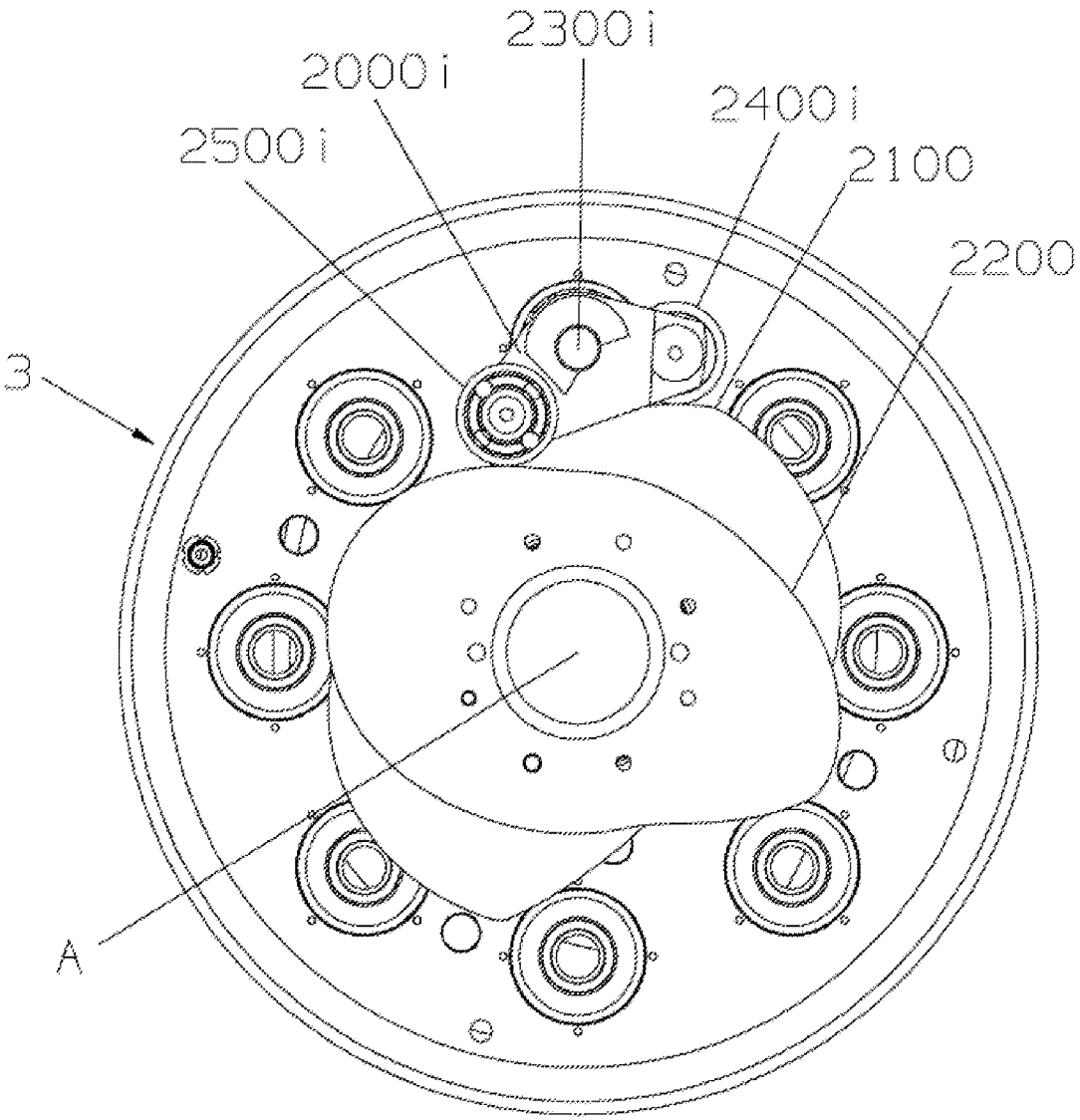
FIG. 12 shows a plan view from below the transfer carousel highlighting the telescopic movement system of an articulated arm.

With reference to FIGS. 9, 10, 11 and 12, a preferred configuration of the transfer devices **200*i*** is shown.

Said devices **200*i* are each formed by a telescopic arm 1000*i* articulated to the carousel 3 and animated by a system of cams which time its movement with that of the cutting means 100 and respectively of the forming means 300 so that there is a null relative speed between the articulated arm 1000*i* and the cutting means 100 and respectively the forming means 300 at the time of the passage of the flat disc 20*i* between one cutting means 100 and the other forming means 300**.

The telescopic arm **1000*i* comprises a first part 1200*i* attached to the carousel 3 with a shaft 1400*i* parallel to the rotation axis A of the carousel 3 and a second part 1300*i* including the circular crown 22*i* and slidingly engaged along a coupling axis with the first part 1200*i***.

The rotary movement of the articulated arm is implemented by a distributor **1900*i* which uses the rotation of the carousel 3 about a fixed cam 1500**.

Said distributor **1900*i* is attached to the carousel 3 by shaft 1800*i* parallel to the rotation axis A of the carousel 3 and comprises a follower 1600*i* of the fixed cam 1500 and a toothed portion 1700*i* which engages with a toothed wheel 1500*i* having as its centrepoint the shaft 1400*i* of the first part 1200*i* of the articulated arm, with which the toothed wheel 1500*i*** is therefore rotationally fixed.

On the other hand, the telescopic movement of the articulated arm **1000*i* is implemented by means of a distributor 2000*i* which uses the rotation of the carousel 3 about a fixed cam, particularly but not necessarily a fixed double cam 2100, 2200**.

Such a distributor **2000*i* is attached to the carousel 3 by shaft 2300*i* parallel to the rotation axis A of the carousel 3 and comprises a follower, particularly but not necessarily a double follower 2400*i*, 2500*i*, of the fixed double cam 2100, 2200, a connecting rod 2600*i* having a first end hinged to a carriage supporting the second part 1300*i* of the articulated arm and a second end hinged to a support 2700*i* having for its part as centrepoint the shaft 2300*i* of the distributor 2000*i*, with which the support 2700*i*** is therefore rotationally fixed.

Incidentally, note that the shafts **2300*i* and 1400*i*** are coaxially arranged one inside the other, the outer one therefore having a tubular shape.

Expediently, the forming means 300 are formed by a plurality of forming devices **300*i* positioned on the circumference of a second carousel 4** rotating about its axis B.

Such a plurality of transfer means **200*i* and such a plurality of continuous retaining devices 600*i* transfer a congruent plurality of flat discs 20*i* from the cutting means 100 to the plurality of forming means 300*i***.

Likewise, the continuous retaining means 700 in the forming means 300 are formed by a plurality of continuous retaining devices **700*i* in the plurality of forming means 300*i***.

Said plurality of forming means 300*i* conforms the plurality of flat discs 20*i* to the shape of a plurality of pleated cups 21*i*.

Expediently, the insertion means 400 are formed by a plurality of insertion means 400*i* positioned on the circumference of the second carousel 4 and vertically coaxial with the forming means 300*i*.

Said plurality of insertion means 400*i* positions a plurality of pleated cups 21*i* in a plurality of waterproof cups 30*i* positioned in a plurality of seats 410*i* positioned on the circumference of the second carousel 4.

The operation of the apparatus for the manufacture of a filter for disposable capsules for the preparation of beverages according to the invention is clear from what is described and illustrated and, in particular, is substantially as follows.

At the cutting station 2, a cutting element 12 cuts a flat disc 20 from the strip of filtering material 10, which flat disc is simultaneously engaged by the pair 501 of oppositely driven pistons 502 and 503, which hold the flat disc 20 and transfer it to an exchange position until it is taken over by the continuous retaining means 600 of the transfer means 200.

The continuous retaining means 600 comprise means for the pneumatic suction of the flat disc 20, comprising transfer means having a partial circular crown 22, and are suitably shaped to allow release of the flat disc 20 by the pair 501 of pistons 502 and 503 and removal thereof following activation of the pneumatic suction.

The rotation of the first rotating carousel 3 about its vertical axis A transfers the transfer means 200 of the flat disc 20 positioned on its circumference to the forming means 300 positioned on the circumference of the second rotating carousel 4 in counter-rotation about its vertical axis B.

The pair of coaxial pistons 701 with opposite activation is activated and engages the flat disc 20 by mechanical retention; only after such engagement is the pneumatic suction of the continuous retaining means 600 deactivated, thus allowing said means to be removed.

Figure 7A:
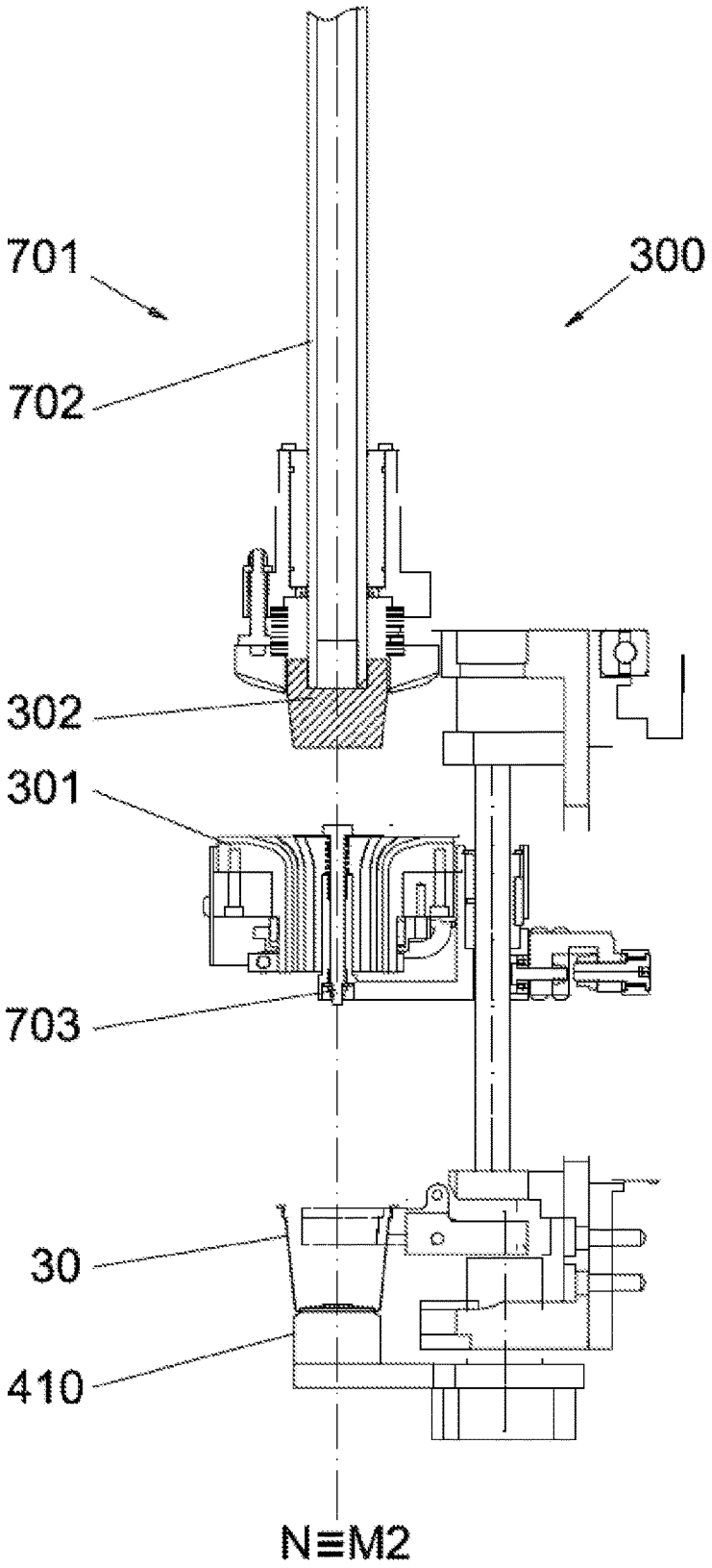
FIG. 7A shows the device in an initial position.
Figure 7B:
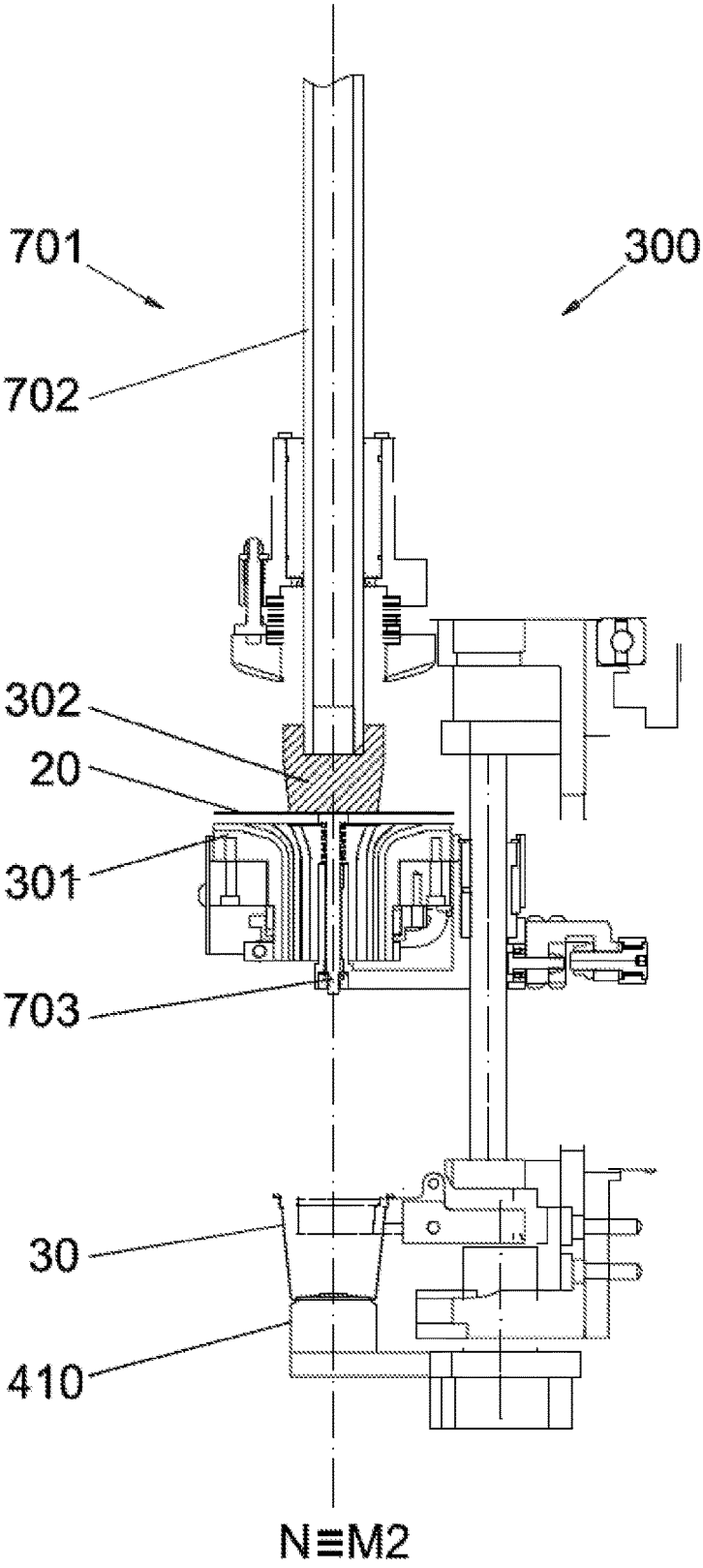
FIG. 7B shows the device gripping the flat disc.
Figure 7C:
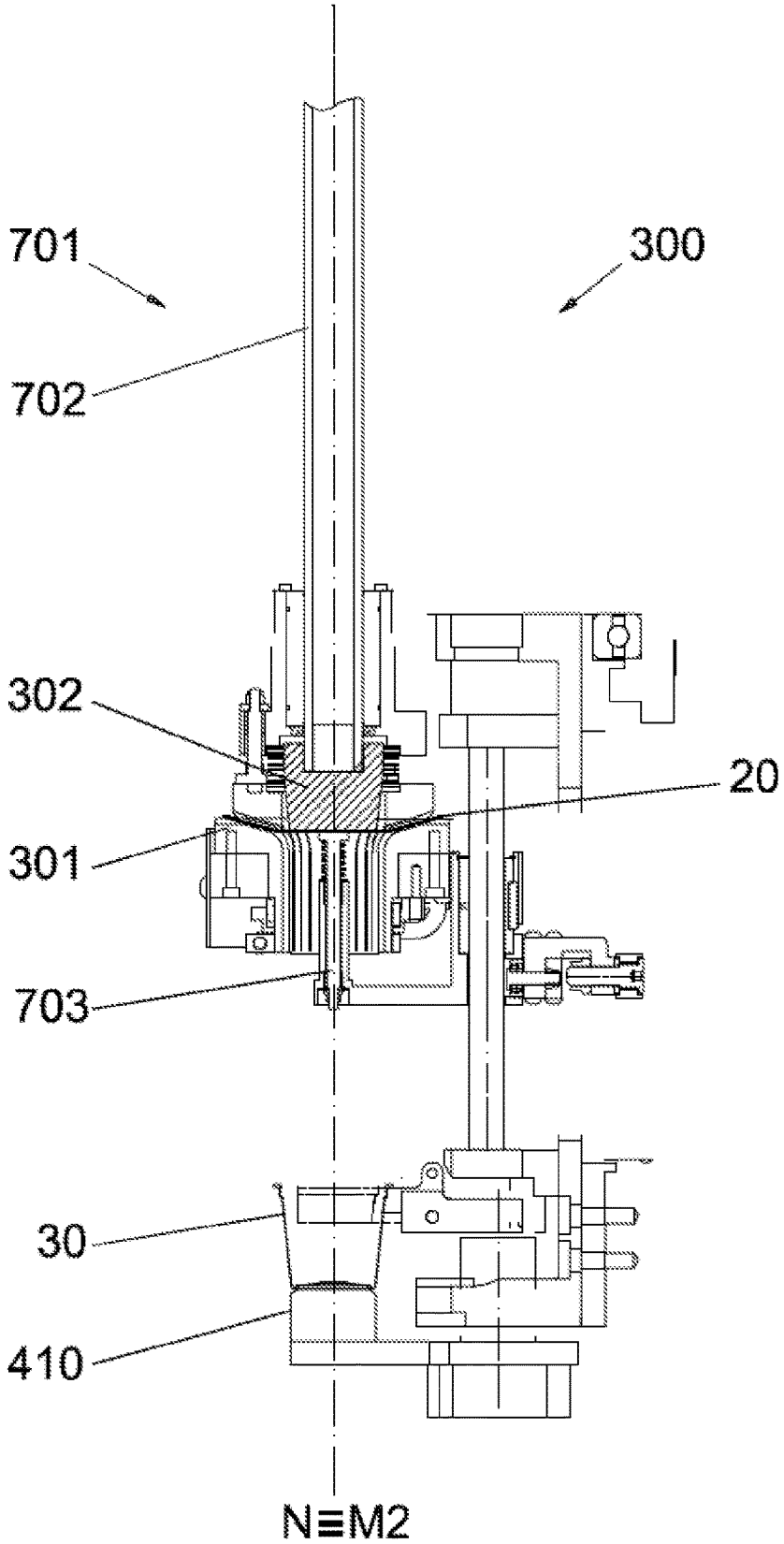
FIG. 7C shows the device in a pre-formed position.
Figure 7D:
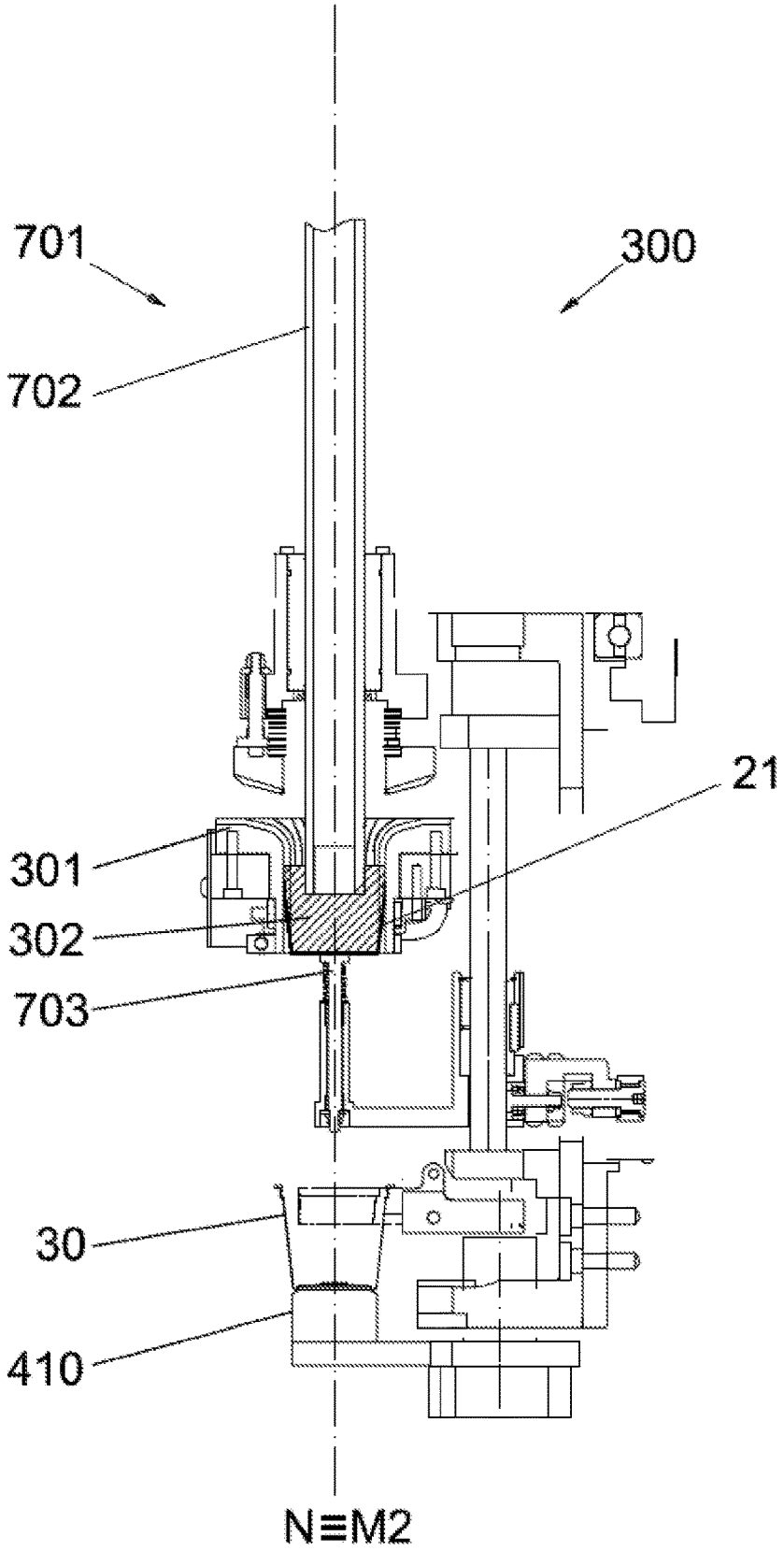
FIG. 7D shows the device in a forming position.
Figure 7E:
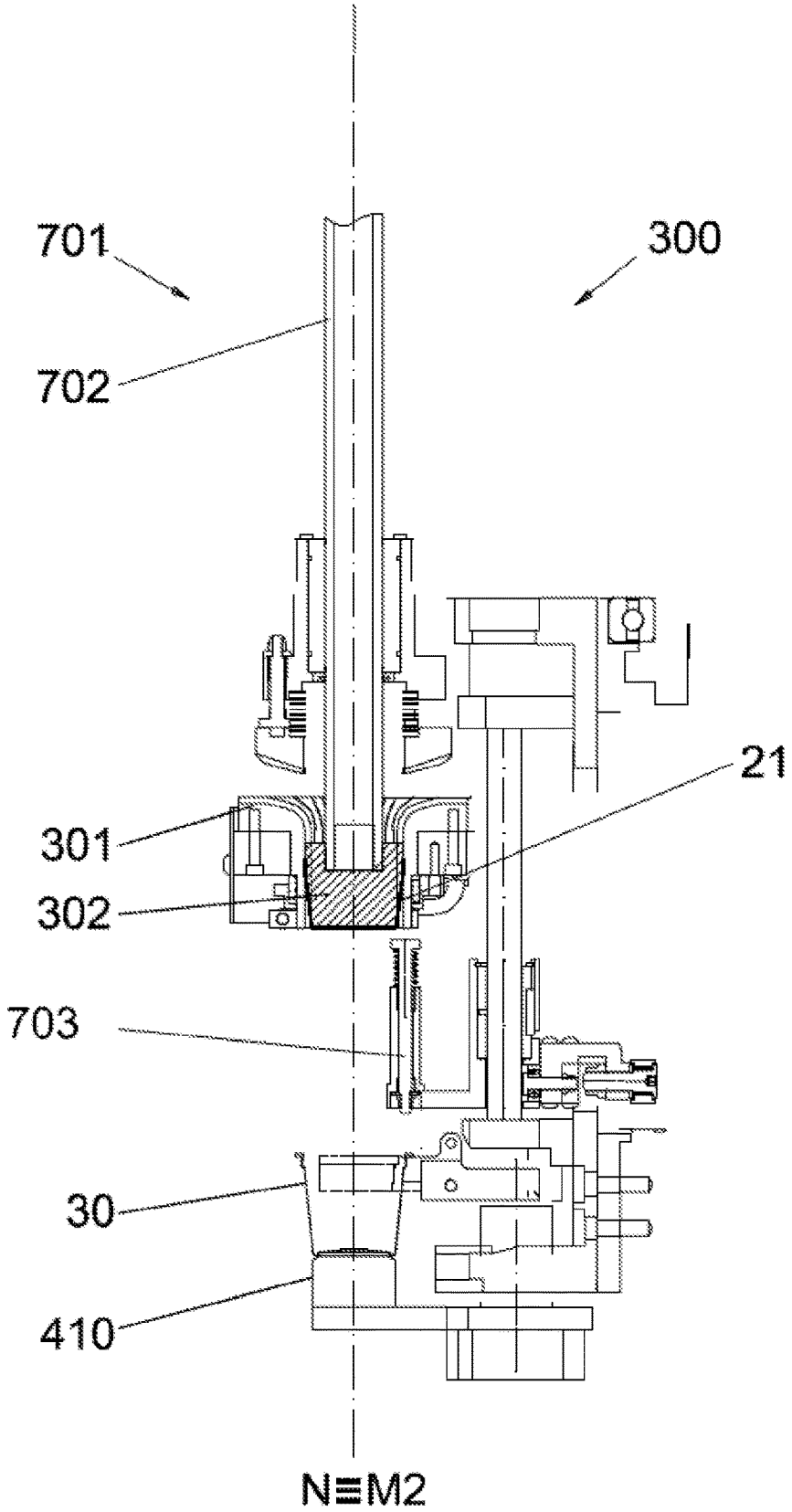
FIG. 7E shows the device in a detached and rotated position.
Figure 7F:
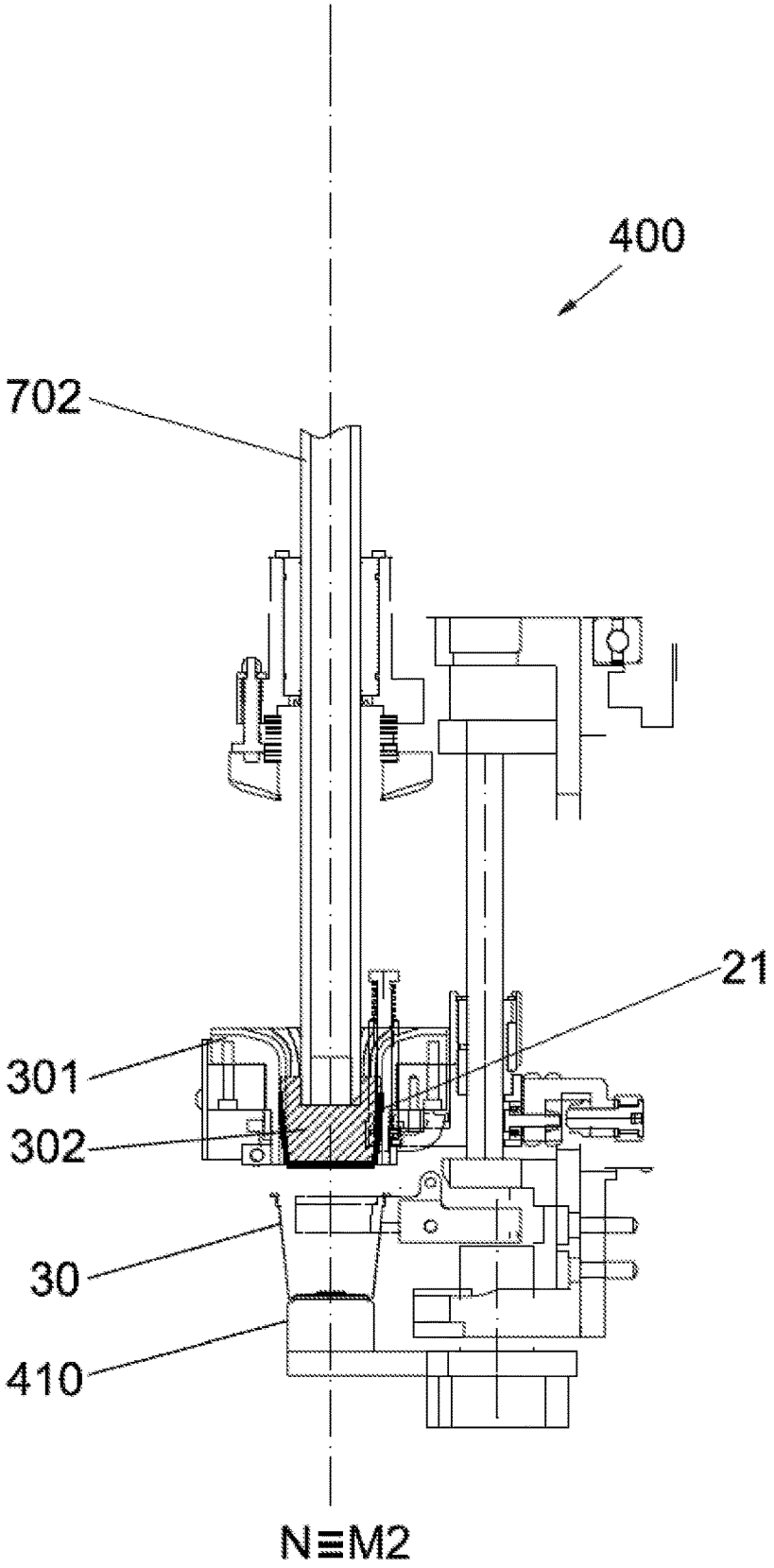
FIG. 7F shows the device in a downward position.
Figure 7G:
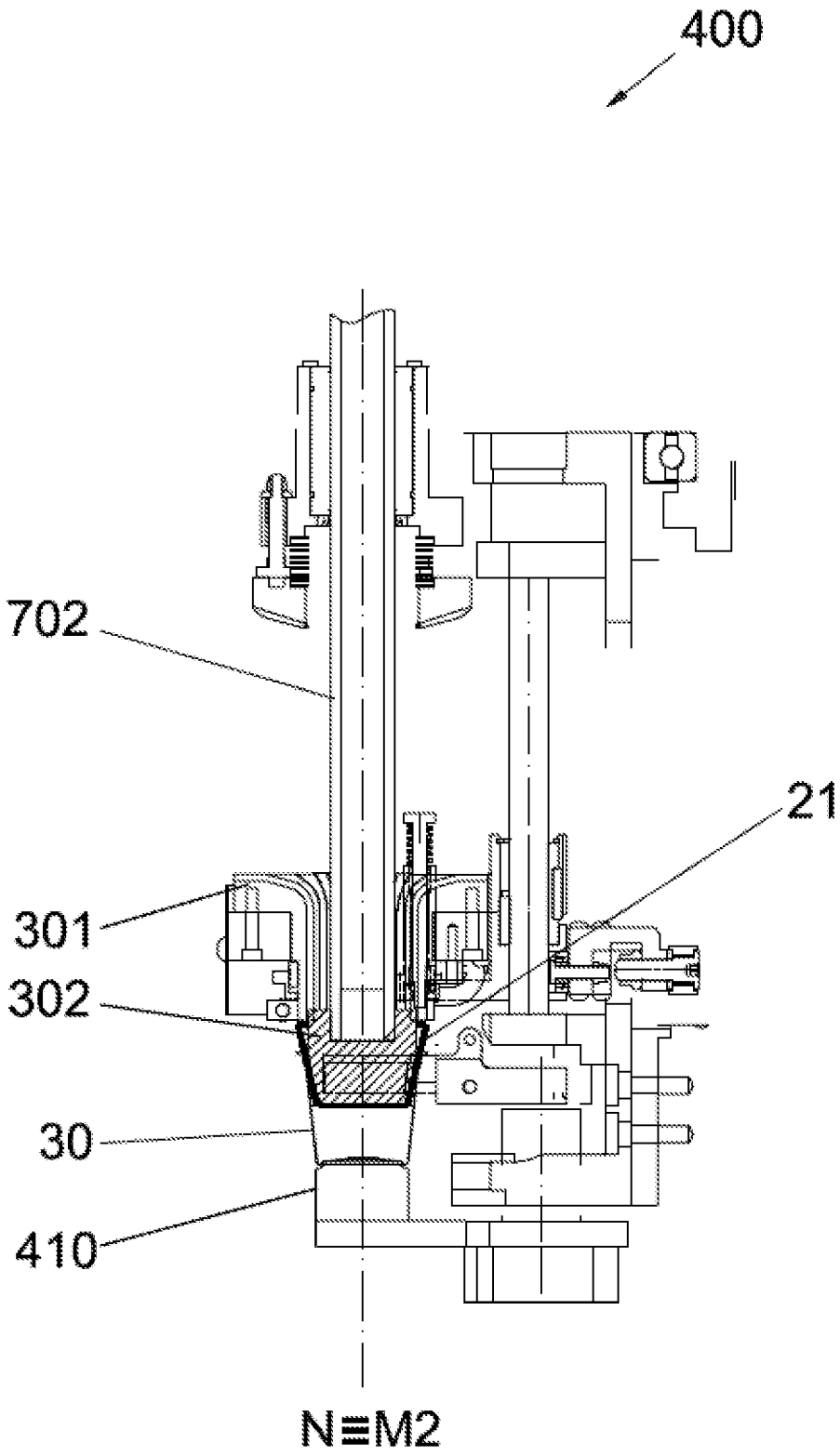
FIG. 7G shows the device in a delivery position.
Figure 7H:
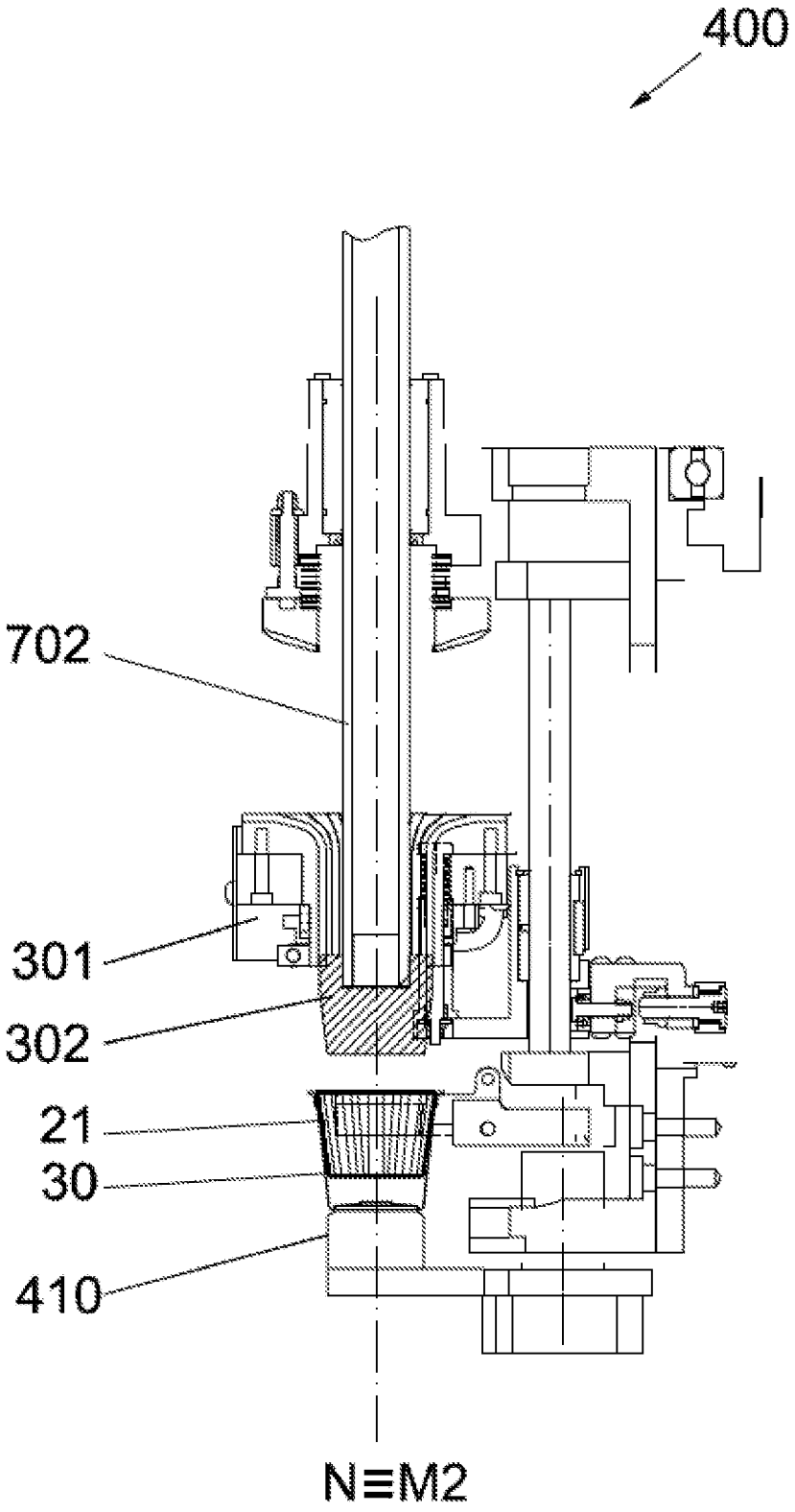
FIG. 7H shows the device in a rising position.
Figure 8:
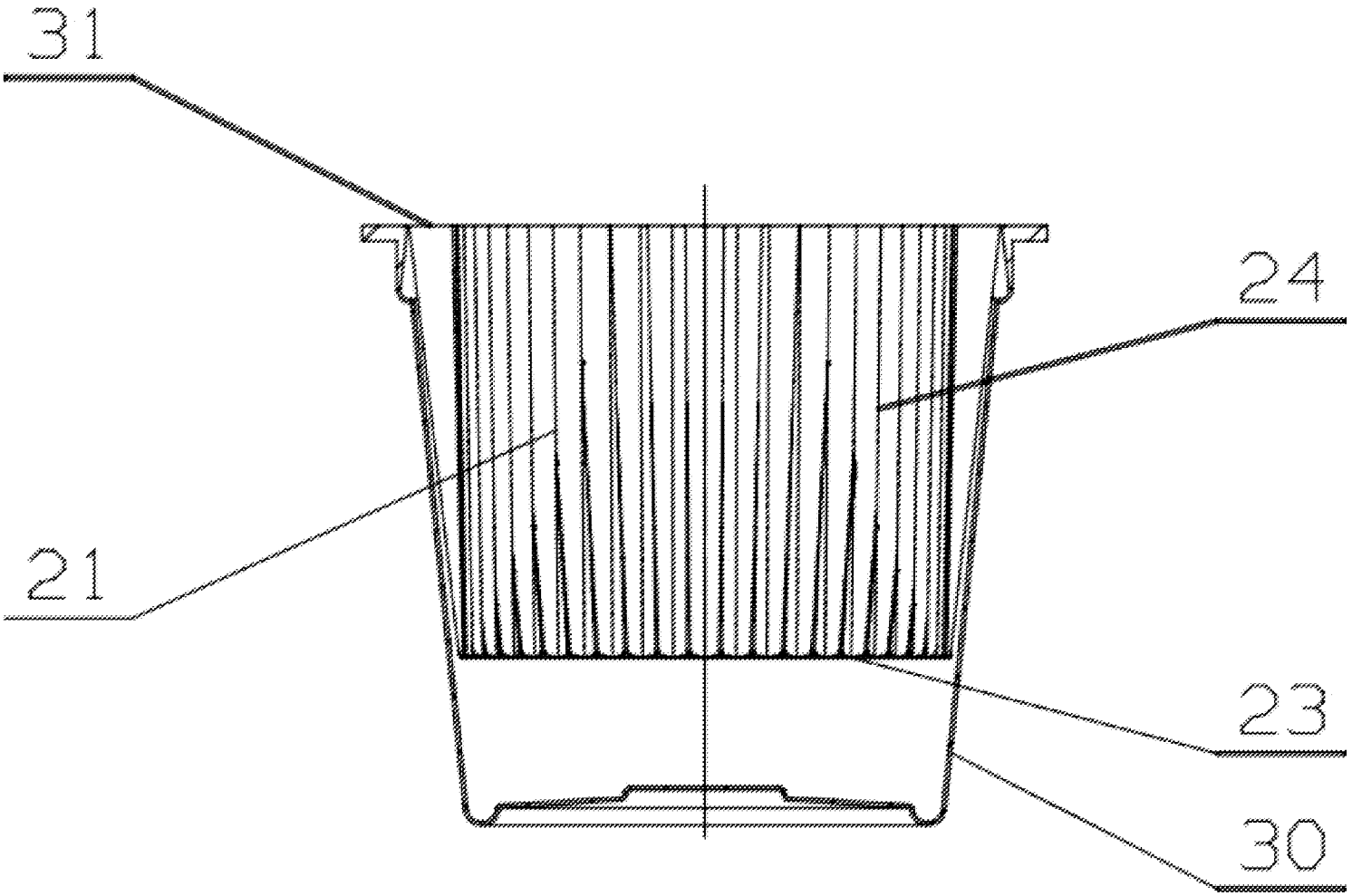
FIG. 8 shows a container with a pleated cup.

As illustrated in sequence in FIGS. 7*a*-7*h*, the forcing means 302 axially transfer along the longitudinal axis M2 the second pair of coaxial pistons 701 that retain the flat disc 20 through the ribbed matrix 301, conforming the flat disc 20 to the shape of a pleated cup 21 with a flat bottom 23—at the point of engagement of the upper opposite coaxial piston 702 with the lower opposite coaxial piston 703 of the second pair of coaxial pistons 701—and a pleating on a lateral perimeter surface 24, forced against the walls of the ribbed matrix 301.

The continuous retaining means 700 engage the flat disc 20 during its conformation in the shape of a pleated cup 21, ensuring that its orthogonal central axis N exactly coincides with the vertical axis M2 of the ribbed matrix 301.

Along the axis M2 and vertically aligned with the forming means 300, insertion means 400 insert the pleated cup 21 inside a waterproof cup 30 positioned in a seat 410 on the circumference of the second carousel 4 and vertically coaxial with the forming means 300 along the axis M2.

Advantageously, the insertion means 400 typically comprise the upper piston 702 of the pair 701 of coaxial pistons, while the lower piston 703 is deactivated and moved away by suitable kinematic means, not shown in the figures.

Typically, the insertion means 400 transfer the upper coaxial piston 702 along its axis M2 by inserting the pleated cup 21 through the mouth 31 of the waterproof cup 30.

The pleated lateral wall 24 no longer retained by the ribbed matrix 301 tends to elastically regain its original shaping and to adhere to the lateral walls of the waterproof cup 30 during insertion.

Mechanical means 402 stop the insertion stroke of the upper piston 702 upon reaching a mechanically predetermined height at which the outer involution circumference of the lateral surface 24 coincides with a reference height of the inner lateral surface of the waterproof cup 30 in proximity to the mouth 31.

The upper piston 702 is then deactivated and removed.

The waterproof cup 30 thus comprising the exactly positioned pleated cup 21 then proceeds to the subsequent stations of the disposable capsule production plant for the preparation of beverages.

Changes and variations, in addition to those already mentioned, are of course possible.

In practice, it has been found that an apparatus for the manufacture of a filter for disposable capsules for the preparation of beverages according to the invention is particularly advantageous in that the preformed filter is continuously retained and precisely positioned in the waterproof container, thus eliminating production waste and enabling a high production speed.

An apparatus for the manufacture of a filter for disposable capsules for the preparation of beverages designed in this way is suitable for numerous modifications and variations, all of which fall within the scope of the inventive concept; moreover, all details are replaceable by technically equivalent elements.

In practice, any materials and also dimensions can be used, according to requirements and the prior the art.

Since the devices and methods described in detail above are examples of embodiments, they can be modified to a wide extent by the skilled person in the usual manner without departing from the scope of the invention. In particular, the mechanical arrangements and the proportions of the individual elements with respect to each other are merely exemplary. Some preferred embodiments of the apparatus according to the invention have been disclosed above. The invention is not limited to the solutions explained above, but the innovative solutions can be applied in different ways within the limits set out by the claims.

The invention claimed is:

1. An apparatus for the manufacture of a filter for disposable capsules for the preparation of beverages from a flat disc made of filtering material, comprising:

a forming device for forming said flat disc to conform said flat disc in a cup shape with a pleating on a lateral perimeter surface thereof, a transfer device for transferring said flat disc to said forming device, and an insertion means for inserting said pleated cup inside a waterproof cup, comprising a retaining device for continuously retaining said flat disc in a predetermined position at least in said transfer device and in said forming device and during the transfer thereof between said transfer device and said forming device.

2. The apparatus for the manufacture of a filter for disposable capsules for the preparation of beverages according to claim 1, comprising a first carousel, wherein said transfer device comprises a transfer device formed by at least one telescopic arm articulated to said first carousel, and wherein a system of cams is provided which animate and time the movement of the telescopic arm with that of said forming device so that there is a null relative speed between said telescopic arm and said forming device at the time of the passage of said flat disc to said forming device.

3. The apparatus for the manufacture of a filter for disposable capsules for the preparation of beverages according to claim 1, wherein the continuous retaining device in said forming device comprises a kinematic mechanism comprising at least one pair of coaxial pistons with opposite activation, said at least one pair of coaxial pistons with opposite activation retaining said flat disc with the central orthogonal axis passing through the centre of the flat disc coinciding with the longitudinal axes of the coaxial pistons.

4. The apparatus for the manufacture of a filter for disposable capsules for the preparation of beverages according to claim 3, said forming device comprising a forcing means that transfers axially along the longitudinal axis said at least one pair of coaxial pistons retaining said flat disc through a ribbed matrix, conforming said flat disc to the shape of said pleated cup.

5. The apparatus for the manufacture of a filter for disposable capsules for the preparation of beverages according to claim 4, said insertion means for inserting said at least one flat disc in the shape of a pleated cup inside a waterproof cup comprising at least one upper coaxial piston of at least one pair of coaxial pistons with opposite activation of said retaining device for continuously retaining.

6. The apparatus for the manufacture of a filter for disposable capsules for the preparation of beverages according to the claim 5, said upper coaxial piston comprising a pneumatic suction means which retains the flat bottom of the pleated cup in an axial position.

7. The apparatus for the manufacture of a filter for disposable capsules for the preparation of beverages according to claim 1, wherein the continuous retaining device in said transfer device comprises a means for the pneumatic suction of said flat disc.

8. The apparatus for the manufacture of a filter for disposable capsules for the preparation of beverages according to claim 7, said means for the pneumatic suction of said flat disc comprising a plurality of partial circular crowns positioned on the circumference of a first carousel.

9. The apparatus for the manufacture of a filter for disposable capsules for the preparation of beverages according to claim 1, comprising a second carousel, wherein said forming device comprises a plurality of forming devices positioned on the circumference of said a second carousel.

10. The apparatus for the manufacture of a filter for disposable capsules for the preparation of beverages according to claim 1, wherein said transfer device engages said at least one flat disc until the subsequent coordinated engagement thereof by said retaining device for continuously retaining.

11. The apparatus for the manufacture of a filter for disposable capsules for the preparation of beverages according to claim 1, said retaining device for continuously retaining engaging said at least one flat disc during its cup-shaped conformation with a pleating on a lateral perimeter surface thereof.

12. The apparatus for the manufacture of a filter for disposable capsules for the preparation of beverages according to claim 1, said forming device comprising at least one ribbed matrix with a smaller inner diameter than the diameter of said at least one flat disc.

13. The apparatus for the manufacture of a filter for disposable capsules for the preparation of beverages according to claim 1, a plurality of waterproof cups being positioned in a plurality of seats positioned on the circumference of said at least one second carousel and vertically coaxial with a plurality of insertion means.

* * * * *